US009684257B1

(12) United States Patent
Farrugia et al.

(10) Patent No.: US 9,684,257 B1
(45) Date of Patent: Jun. 20, 2017

(54) TONER COMPOSITIONS WITH ANTIPLASTICIZERS

(71) Applicant: XEROX CORPORATION, Norwalk, CT (US)

(72) Inventors: Valerie M. Farrugia, Oakville (CA); Richard P. N. Veregin, Mississauga (CA); Michael S. Hawkins, Cambridge (CA)

(73) Assignee: XEROX CORPORATION, Norwalk, CT (US)

( * ) Notice: Subject to any disclaimer, the term of this patent is extended or adjusted under 35 U.S.C. 154(b) by 0 days.

(21) Appl. No.: 15/187,545

(22) Filed: Jun. 20, 2016

(51) Int. Cl.
*G03G 9/093* (2006.01)

(52) U.S. Cl.
CPC ..... *G03G 9/09371* (2013.01); *G03G 9/09392* (2013.01)

(58) Field of Classification Search
CPC ..... G03G 9/09321; G03G 9/09364
See application file for complete search history.

(56) References Cited

U.S. PATENT DOCUMENTS

| | | | | |
|---|---|---|---|---|
| 4,457,998 | A | 7/1984 | Gruber et al. | |
| 5,290,654 | A | 3/1994 | Sacripante et al. | |
| 5,302,486 | A | 4/1994 | Patel et al. | |
| 5,556,732 | A | 9/1996 | Chow | |
| 6,177,223 | B1 * | 1/2001 | Hashimoto | G03G 9/0821 430/110.1 |
| 7,524,602 | B2 | 4/2009 | Vanbesien et al. | |
| 7,645,551 | B2 | 1/2010 | Sifain | |
| 2007/0218391 | A1 * | 9/2007 | Yamada | G03G 9/0806 430/109.4 |
| 2015/0056551 | A1 | 2/2015 | Schneider et al. | |
| 2017/0010553 | A1 * | 1/2017 | Veregin | G03G 9/09364 |

* cited by examiner

*Primary Examiner* — Hoa V Le
(74) *Attorney, Agent, or Firm* — Pillsbury Winthrop Shaw Pittman LLP

(57) ABSTRACT

Disclosed herein include styrene-acrylic-based binder compositions containing an antiplasticizer with particles having a core-shell type structure and methods for their preparation.

20 Claims, 5 Drawing Sheets

LOCAL ELASTIC CONSTANTS IN FRAGILE GLASS FORMERS

LOCAL ELASTIC CONSTANTS IN STRONG GLASS FORMERS

TONER COMPOSITIONS WITH ANTIPLASTICIZERS

BACKGROUND

The present disclosure relates to toner compositions with toner particles having a core-shell type structure and antiplasticizers in the core and/or shell. More particularly, embodiments herein relate to hybrid toner compositions.

Hybrid toners having some of the polyester resin latex replaced by a styrene/acrylate latex is a key in facilitating future cost reduction for certain toner products. For example, hybrid toners may contain a styrene/acrylate shell and a core comprising a styrene-acrylate copolymer and amorphous polyester. By replacing the polyester with more styrene/acrylate copolymer, the cost is reduced as polyester is traditionally a more expensive material. Not only are the polyester raw materials generally more expensive, but to prepare polyester latex to enable use in emulsion-aggregation toner requires an additional processing step, which often requires the use of solvents, verses styrene/acrylate copolymers can be directly prepared as a latex when the resin is prepared by emulsion polymerization. However, it was discovered that toners with styrene-acrylate latexes do not melt at the same temperature during the toner process as the polyester toners, thus leading to variation in the surface morphology in a hybrid of the two toner types (more polystyrene/acrylate remains on the surface). For example, a polyester emulsion/aggregation toner prepared by a batch process is generally coalesced at temperatures from about 70° C. to about 86° C., for example, US patent application 20150056551, while a styrene/acrylate toner is generally coalesced at temperatures above 90° C., typically from 95 to 96° C., as for example in U.S. Pat. No. 7,645,551, herein included by reference.

A potential approach to address this mismatch is to elevate the coalescence temperature in the EA process from the conventional coalescence temperature of 85° C., but increasing the coalescence temperature cause pigment coagulation to take place and results in dielectric loss. This is because, especially for hybrid toners where the core contains both styrene/acrylate resin and polyester resin, the pigment (e.g., carbon black for black toner) preferentially situated in the polyester resin portion of the toner or in the interface of the styrene/acrylate and polyester, and therefore is unable to disperse into the styrene/acrylate resin portion of the toner. With less polyester presented in the toner due to the replacement with styrene/acrylate, the local concentration of the carbon black increases, leading to a higher chance that carbon black particles are in contact with one another, thus increases the conductivity of the toner as measured by dielectric loss. Therefore, such poor pigment dispersion leads to high dielectric loss, which in turn leads to poor transfer efficiency in the printer, and, in some cases, lower charge as well. Reducing the coalescence temperature in polyester toners may reduce the dielectric loss, but once styrene/acrylate is added to the polyester core emulsion, the coalescence temperature is required to be raised to ensure a fully coalesced styrene/acrylate shell.

It is found that the polyester portion of the hybrid toners has a lower viscosity and higher molecular mobility compared to the styrene/acrylate portion. This results in incompatibility of the polymers causing pooling or large domains of the same polymer material (i.e., poor intermolecular mixing) within the toner particle, therefore causing poor distribution of the carbon black and possibly the wax (release aid).

The inventors of the present disclosure discovered that by including an antiplasticizer, such as a low molecular weight organic material, can help antiplasticize the polymers, and thus can solve the aforementioned problems.

SUMMARY

According to embodiments illustrated herein, there is provided a toner composition comprising particles having a core and a shell disposed over the core, wherein the core comprises a first antiplasticizer; a first styrene-acrylate resin; a polyester resin; the shell comprises a second styrene-acrylate resin.

In specific embodiments, there is provided a toner composition comprising toner particles having a core and a shell disposed over the core, wherein the core comprises from a first antiplasticizer, a first styrene-acrylate resin; a polyester resin; and the shell comprises a second styrene-acrylate resin.

In other embodiments, there is provided a method of making a toner comprising providing an emulsion comprising a resin, an optional colorant, and an optional wax, and an antiplasticizer, wherein the resin comprises a first styrene-acrylate resin and a polyester resin; aggregating the emulsion to form particle cores; forming a shell over the particle cores to form particles, wherein the shell comprises a second styrene-acrylate resin; and coalescing the particles.

BRIEF DESCRIPTION OF THE DRAWINGS

For a better understanding of the present embodiments, reference may be made to the accompanying figures.

DETAILED DESCRIPTION

In the following description, it is understood that other embodiments may be utilized and structural and operational changes may be made without departure from the scope of the present embodiments disclosed herein.

In this specification and the claims that follow, singular forms such as "a," "an," and "the" include plural forms unless the content clearly dictates otherwise. All ranges disclosed herein include, unless specifically indicated, all endpoints and intermediate values.

The present disclosure provides compositions including one or more antiplasticizer to help antiplasticize the resins. The one or more antiplasticizer may be incorporated into the core of the composition, or the one or more antiplasticizer may be incorporated into both the core and the shell of the composition. In embodiments, the core includes a first antiplasticizer. In embodiments, the shell includes a second antiplasticizer. In embodiments, the shell also includes a second antiplasticizer. The first antiplasticizer may be the same or different from the second antiplasticize. The first antiplasticizer may include one or more antiplasiticizer. The second antiplasticizer may include one or more antiplasiticizer. In embodiments, the compositions of the present disclosure are toner compositions.

An antiplasticized resin is described as a resin having a higher modulus, higher ultimate strength, lower ultimate elongation and lower glass transition temperature than its pure or neat version. The properties of an antiplasticized resin ultimately result from the reduction of its molecular mobility or its movement. The resin-additive interaction causes a decrease in free volume which reduces the resins mobility or basically locks the polymer segments in place, thereby not allowing the resin to move around as much. Such antiplasticization effect has to do with the functional groups on a "plasticizer" (i.e., some plasticizers can also be antiplasticizers) that strongly interact with the resin and cause a depression in Tg, but at the same time also increase the stiffness (shear or bulk modulus) of resin material. Therefore, the major distinction between an antiplasticized resin and a plasticized resin is in their thermal and mechanical properties.

Figure 1:
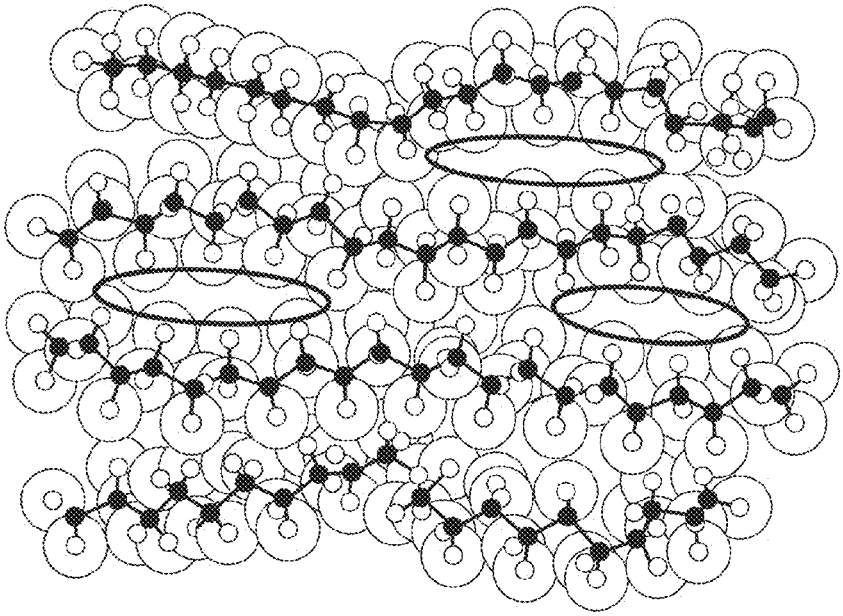
FIG. 1 is a cartoon illustrating a frame format of a polymer chain molecules clustered in an amorphous area. The gaps are created when the molecules gather (as seen by red ellipses); these gaps are called free volume. (http://www.soarnol.com/eng/solution/solution060313.html)

FIG. 1 shows a resin chain molecules clustered in an amorphous area. Gaps are created when the molecules gather (as seen by ellipses), and these gaps are referred to as free volume.

Figure 2A:
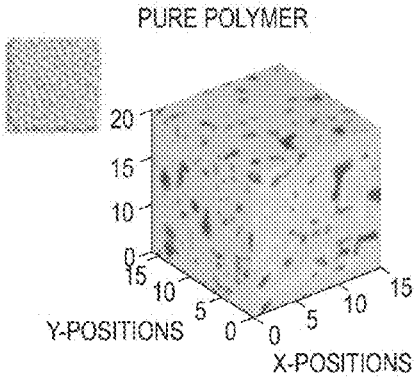
FIG. 2*a* shows a computer simulated model predictions of 3-dimensional image of a pure polymer showing that local mobility affects local molecular stiffness and elastic constants when a polymer is antiplasticized.
Figure 2B:
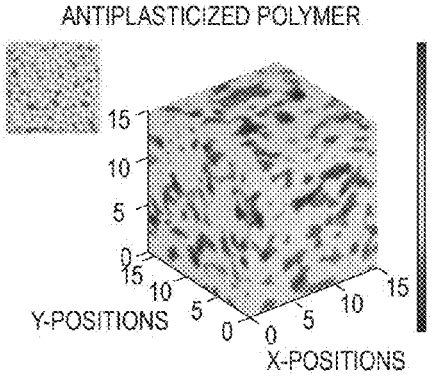
FIG. 2*b* shows a computer simulated model predictions of 3-dimensional image of an antiplasticized polymer according to the present embodiments.

FIG. 2*a* shows computer simulated model predictions of 3-dimensional image of a pure polymer and FIG. 2*b* shows computer simulated model predictions of 3-dimensional image of an antiplasticized polymer according to the present embodiments. The figures show that local mobility affects local molecular stiffness and elastic constants when a resin is antiplasticized. (Robert Riggleman, Jack Douglasb and Juan J. de Pablo, Soft Matter 6 (2010)).

The antiplasticizer of the present embodiments may be small organic molecules which allow them to penetrate into the free volume space of the polymer chains as seen in FIG. 1. The antiplasticizers may be liquid at room temperature. Depending on the antiplasticizer's chemical composition, the liquid phase can range as low as −30° C. to over 500° C., for example, the antiplasticizer can be in a liquid phase at a temperature in the range from about −30 to about 300° C., from about −20 to about 300° C., or from about −10 to about 250° C.

Examples of suitable antiplasticizer of the present embodiments include, but are not limited to, alkyl benzoate, such as methyl benzoate, methyl benzoate, ethyl benzoate, propyl benzoate, butyl benzoate, amyl benzoate, lauryl/myristyl benzoate, C12-15 alkyl benzoate, C16-17 alkyl benzoate, stearyl benzoate, behenyl benzoate, isopropyl benzoate, isobutyl benzoate, isostearyl benzoate, ethylhexyl benzoate, butyloctyl benzoate, hexyldecyl benzoate, and octyldodecyl benzoate; citrate such as substituted citrate, e.g., triethyl citrate, trimethyl citrate, acetyl tri-n-butyl citrate, acetyl triethyl citrate, tri-n-butyl citrate; phthalate such as substituted phthalate, e.g., dimethyl phthalate, diethyl phthalate, diallyl phthalate, di-n-propyl phthalate, di-n-butyl phthalate, diisobutyl phthalate, butyl cyclohexyl phthalate, di-n-pentyl phthalate, dicyclohexyl phthalate, butyl benzyl phthalate, di-n-hexyl phthalate, diisohexyl phthalate, diisoheptyl phthalate, butyl decyl phthalate, di(2-ethylhexyl) phthalate, di(n-octyl) phthalate, diisooctyl phthalate, n-octyl n-decyl phthalate, diisononyl phthalate, di(2-propylheptyl) phthalate, diisodecyl phthalate, diundecyl phthalate, diisoundecyl phthalate, ditridecyl phthalate, diisotridecyl phthalate; alkyl toluate, such as monoester alkyl toluate, diester alkyl toluate, and the like, specific examples of alkyl toluate include hexyl-p-toluate (hexyl 4-methylbenzoate), propyl-p-toluate, butyl-p-toluate, pentyl-p-toluate, ethylhexyl-p-toluate, isononyl-p-toluate, propylheptyl-p-toluate, isoundecyl-p-toluate and mixtures thereof.

The amount of the first antiplasticizer included in the core can be from about 0.1 wt % to about 10 wt %, from about 0.2 wt % to about 6 wt %, or from about 0.5 wt % to about 5 wt % based on the total weight of the toner composition. The amount of the second antiplasticizer included in the shell can be from about 0.1 wt % to about 10 wt %, from about 0.2 wt % to about 6 wt %, or from about 0.5 wt % to about 5 wt % based on the total weight of the toner composition. The total amount of antiplasticizer (i.e., first antiplasticizer+second antiplasticizer) in the composition can be from about 0.1 wt % to about 10 wt %, from about 0.2 wt % to about 6 wt %, or from about 0.5 wt % to about 5 wt % based on the total weight of the toner composition.

Styrene-Acrylate Resin

The core may include a first styrene-acrylate resin. The shell may include a second styrene-acrylate resin. The first styrene-acrylate resin in the core and the second styrene-acrylate resin in the shell may be the same or different. Illustrative examples of specific polymers for the first and second styrene-acrylate resins include, for example, poly (styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly(alkyl methacrylate-aryl acrylate), poly(aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butyl acrylate-acrylic acid), poly(styrene-butyl acrylate-methacrylic acid), poly (styrene-butyl acrylate-acrylonitrile), poly(styrene-butyl acrylate-acrylonitrile-acrylic acid), poly(styrene-1,3-diene), poly(styrene-1,3-diene-acrylic acid), poly (styrene-1,3-diene-acrylonitrile-acrylic acid), poly(styrene-butadiene), poly(methylstyrene-butadiene), poly (styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly (styrene-butyl methacrylate), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures thereof. The alkyl group in the aforementioned polymers may be any alkyl group, and in particular may be a $C_1$-$C_{12}$ alkyl group, for example including methyl, ethyl, propyl and butyl. As the aryl group, any aryl group known in the art may be used.

In embodiments, the styrene-acrylate resin in the core and the styrene-acrylate resin in the shell may be, independently, styrene-alkyl acrylate, more particularly a styrene-butyl acrylate polymer such as a styrene-butyl acrylate polymer.

In embodiments, the styrene-acrylate resin in the core and the styrene-acrylate resin in the shell each include a styrene monomer and an acrylic monomer. In embodiments, the first resin further comprises at least one cross-linker. In embodiments, the second resin further comprises at least one cross-linker.

As used herein, the term "styrene monomer" refers to styrene per se, as well as styrene containing one or more substitutions, such as 3-chlorostyrene, 2,5-dichlorostyrene, 4-bromostyrene, 4-tert-butylstyrene, 4-methoxystyrene and the like.

As used herein, the term "acrylic acid monomer" refers to acrylic acid, methacrylic acid, and β-CEA. As used herein, the term "acrylic ester monomer" refers to esters of acrylic acid and methacrylic acid. Acrylic ester monomers include, but are not limited to, butyl acrylate, butyl methacrylate, propyl acrylate, propyl methacrylate, ethyl acrylate, ethyl methacrylate, methyl acrylate and methyl methacrylate. In certain embodiments, the acrylic ester monomer is n-butyl acrylate.

In embodiments, the styrene monomer is present in the core in an amount of from about 4 to about 50, or from about 7 to about 40 weight percent by weight of the composition. In embodiments, the acrylic ester monomer is present in the core in an amount of from about 1 to about 30, or from about 2 to about 18 weight percent by weight of the composition. In embodiments, the styrene monomer is present in the shell in an amount of from about 4 to about 40, or from about 6 to about 30 weight percent by weight of the composition. In embodiments, the acrylic ester monomer is present in the shell in an amount of from about 0.5 to about 30, or from about 1 to about 25 weight percent by weight of the composition.

In embodiments, the first styrene-acrylate resin is present in the core in an amount of from about 7 to about 50 percent by weight of the total weight of the composition. In embodiments, the second styrene-acrylate resin is present in the shell in an amount of from about 7 to about 50 percent by weight of the total weight of the composition.

In embodiments, the styrene-acrylate resin in the core includes styrene and n-butyl acrylate. In embodiments, the styrene-acrylate resin in the shell includes styrene and n-butyl acrylate.

The styrene-acrylate resin in the core may have a mean particle size of from about 100 nm to about 250 nm, from about 100 nm to about 140 nm, from about 140 nm to about 200 nm, or from about 140 to about 250 nm.

The styrene-acrylate resin in the shell may have a mean particle size of from about 100 nm to about 250 nm, from about 100 nm to about 140 nm, from about 140 nm to about 200 nm, or from about 140 to about 250 nm.

Amorphous Polyester Resin

The toner composition of the present disclosure include core particles comprises an amorphous polyester resin. The amorphous polyester resin may be formed by reacting a diol with a diacid in the presence of an optional catalyst. Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis(2-hydroxyethyl) oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

Polycondensation catalysts which may be utilized in forming either the crystalline or amorphous polyesters include tetraalkyl titanates, dialkyltin oxides such as dibutyltin oxide, tetraalkyltins such as dibutyltin dilaurate, and dialkyltin oxide hydroxides such as butyltin oxide hydroxide, aluminum alkoxides, alkyl zinc, dialkyl zinc, zinc oxide, stannous oxide, or combinations thereof. Such catalysts may be utilized in amounts of, for example, from about 0.01 mole percent to about 5 mole percent based on the starting diacid or diester used to generate the polyester resin. In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, as noted above, an unsaturated amorphous polyester resin may be utilized as a latex resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly (propoxylated bisphenol co-itaconate), poly(ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

In embodiments, a suitable polyester resin may be an amorphous polyester such as a poly(propoxylated bisphenol A co-fumarate) resin having the following formula (I):

(I)

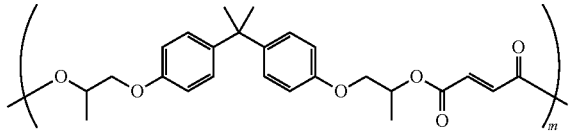

wherein m may be from about 5 to about 1000. Examples of such resins and processes for their production include those disclosed in U.S. Pat. No. 6,063,827, the disclosure of which is hereby incorporated by reference in its entirety.

An example of a linear propoxylated bisphenol A fumarate resin which may be utilized as a latex resin is available under the trade name SPARII from Resana S/A Industrias Quimicas, Sao Paulo Brazil. Other propoxylated bisphenol A fumarate resins that may be utilized and are commercially available include GTUF and FPESL-2 from Kao Corporation, Japan, and EM181635 from Reichhold, Research Triangle Park, N.C., and the like.

In embodiments, the resins utilized as the resin coating may have a glass transition temperature of from about 30° C. to about 80° C., in embodiments from about 35° C. to about 70° C. In further embodiments, the resins utilized as the resin coating may have a melt viscosity of from about 10 to about 1,000,000 Pa*S at about 130° C., in embodiments from about 20 to about 100,000 Pa*S.

The amorphous polyester resin may be present in the core, for example, in an amount of from about 10 to about 95 percent by weight of the toner, in embodiments from about 20 to about 80 percent by weight, or from about 40 to about 70 percent by weight of the toner.

Crystalline Polyester Resin

A "crystalline polyester resin" indicates one that shows not a stepwise endothermic amount variation but a clear endothermic peak in differential scanning calorimetry (DSC). However, a polymer obtained by copolymerizing the crystalline polyester main chain and at least one other component is also called a crystalline polyester if the amount of the other component is 50% by weight or less.

The crystalline polyester resins, which are available from a number of sources, can be prepared by a polycondensation process by reacting an organic diol, and an organic diacid in the presence of a polycondensation catalyst. Generally, a stoichiometric equimolar ratio of organic diol and organic diacid is utilized, however, in some instances, wherein the boiling point of the organic diol is from about 180° C. to about 230° C., an excess amount of diol can be utilized and removed during the polycondensation process. The amount of catalyst utilized varies, and can be selected in an amount, for example, of from about 0.01 to about 1 mole percent of the resin. Additionally, in place of the organic diacid, an organic diester can also be selected, and where an alcohol byproduct is generated.

Examples of organic diols include aliphatic diols with from about 2 to about 36 carbon atoms, such as 1,2-ethanediol, 1,3-propanediol, 1,4-butanediol, 1,5-pentanediol, 1,6-hexanediol, 1,7-heptanediol, 1,8-octanediol, 1,9-nonanediol, 1,10-decanediol, 1,12-dodecanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixture thereof, and the like. The aliphatic diol is, for example, selected in an amount of from about 45 to about 50 mole percent of the resin, and the alkali sulfo-aliphatic diol can be selected in an amount of from about 1 to about 10 mole percent of the resin.

Examples of organic diacids or diesters selected for the preparation of the crystalline polyester resins include oxalic acid, succinic acid, glutaric acid, adipic acid, suberic acid, azelaic acid, sebacic acid, phthalic acid, isophthalic acid, terephthalic acid, napthalene-2,6-dicarboxylic acid, naphthalene-2,7-dicarboxylic acid, cyclohexane dicarboxylic acid, malonic acid and mesaconic acid, a diester or anhydride thereof; and an alkali sulfo-organic diacid such as the sodio, lithio or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfo-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methyl-pentanediol, 2-sulfo-3,3-dimethylpentanediol, sulfo-p-hydroxybenzoic acid, N,N-bis(2-hydroxyethyl)-2-amino ethane sulfonate, or mixtures thereof. The organic diacid is selected in an amount of, for example, from about 40 to about 50 mole percent of the resin, and the alkali sulfoaliphatic diacid can be selected in an amount of from about 1 to about 10 mole percent of the resin. There can be selected for the third latex branched amorphous resin an alkali sulfonated polyester resin. Examples of suitable alkali sulfonated polyester resins include, the metal or alkali salts of copoly(ethylene-terephthalate)-copoly-(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly (propylene-diethylene-terephthalate)-copoly(propylene-diethylene-5-sulfo-isophthalate), copoly(propylene-butylene-terephthalate)-copoly(propylene-butylene-5-sulfo-isophthalate), copoly-(propoxylated bisphenol-A-fumarate)-copoly(propoxylated bisphenol-A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), and wherein the alkali metal is, for example, a sodium, lithium or potassium ion.

Examples of crystalline based polyester resins include alkali copoly(5-sulfo-isophthaloyl)-co-poly(ethylene-adipate), alkali copoly(5-sulfo-isophthaloyl)-copoly(propylene-adipate), alkali copoly(5-sulfo-isophthaloyl)-copoly (butylene-adipate), alkali copoly(5-sulfo-isophthaloyl)-copoly(pentylene-adipate), alkali copoly(5-sulfo-isophthaloyl)-copoly(octylene-adipate), alkali copoly(5-sulfo-isophthaloyl)-copoly(ethylene-adipate), alkali copoly (5-sulfo-isophthaloyl)-copoly (propylene-adipate), alkali copoly(5-sulfo-isophthaloyl)-co-poly(butylene-adipate), alkali copoly(5-sulfo-isophthaloyl)-copoly(pentylene-adipate), alkali copoly(5-sulfo-isophthaloyl)-copoly(hexylene-adipate), alkali copoly(5-sulfo-isophthaloyl)-copoly(octylene-adipate), alkali copoly(5-sulfo-isophthaloyl)-copoly (ethylene-succinate), alkali copoly(5-sulfo-isophthaloyl-copoly(butylene-succinate), alkali copoly(5-sulfo-isophthaloyl)-copoly(hexylene-succinate), alkali copoly(5-sulfo-isophthaloyl)-copoly(octylene-succinate), alkali copoly(5-sulfo-isophthaloyl)-copoly(ethylene-sebacate), alkali copoly(5-sulfo-isophthaloyl)-copoly(propylene-sebacate), alkali copoly(5-sulfo-isophthaloyl)-copoly(butylene-sebacate), alkali copoly(5-sulfo-isophthaloyl)-copoly(pentylene-sebacate), alkali copoly(5-sulfo-isophthaloyl)-copoly (hexylene-sebacate), alkali copoly(5-sulfo-isophthaloyl)-copoly(octylene-sebacate), alkali copoly(5-sulfo-isophthaloyl)-copoly(ethylene-adipate), alkali copoly(5-sulfo-isophthaloyl)-copoly(propylene-adipate), alkali copoly(5-sulfo-isophthaloyl)-copoly(butylene-adipate), alkali copoly(5-sulfo-isophthaloyl)-copoly(pentylene-adipate), alkali copoly(5-sulfo-isophthaloyl)-copoly(hexylene-adipate), poly(octylene-adipate); and wherein alkali is a metal of sodium, lithium or potassium, and the like. In embodiments, the alkali metal is lithium.

The crystalline polyester resin may be present in the core, for example, in an amount of from about 5 to about 50 percent by weight of the toner components, in embodiments from about 10 to about 35 percent by weight of the toner components. The crystalline resin can possess various melting points of, for example, from about 30° C. to about 120° C., in embodiments from about 50° C. to about 90° C. The crystalline resin may have a number average molecular weight (Mn), as measured by gel permeation chromatography (GPC) of, for example, from about 1,000 to about 50,000, in embodiments from about 2,000 to about 25,000, and a weight average molecular weight (Mw) of, for example, from about 2,000 to about 100,000, in embodiments from about 3,000 to about 80,000, as determined by Gel Permeation Chromatography using polystyrene standards. The molecular weight distribution (Mw/Mn) of the crystalline resin may be, for example, from about 2 to about 6, in embodiments from about 3 to about 4.

Surfactants

Any suitable surfactants may be used for the preparation of the latex and wax dispersions according to the present disclosure. Depending on the emulsion system, any desired nonionic or ionic surfactant such as anionic or cationic surfactant may be contemplated.

Examples of suitable anionic surfactants include, but are not limited to, sodium dodecylsulfate, sodium dodecylbenzene sulfonate, sodium dodecylnaphthalenesulfate, dialkyl benzenealkyl sulfates and sulfonates, abitic acid, NEOGEN R® and NEOGEN SC® available from Kao, Tayca Power®, available from Tayca Corp., DOWFAX®, available from Dow Chemical Co., and the like, as well as mixtures thereof. Anionic surfactants may be employed in any desired or effective amount, for example, at least about 0.01% by weight of total monomers used to prepare the latex polymer, at least about 0.1% by weight of total monomers used to prepare the latex polymer; and no more than about 10% by weight of total monomers used to prepare the latex polymer, no more than about 5% by weight of total monomers used to prepare the latex polymer, although the amount can be outside of those ranges.

Examples of suitable cationic surfactants include, but are not limited to, dialkyl benzenealkyl ammonium chloride, lauryl trimethyl ammonium chloride, alkylbenzyl methyl ammonium chloride, alkyl benzyl dimethyl ammonium bromide, benzalkonium chloride, cetyl pyridinium bromide, $C_{12}$, $C_{15}$ and $C_{17}$ trimethyl ammonium bromides, halide salts of quaternized polyoxyethylalkylamines, dodecylbenzyl triethyl ammonium chloride, MIRAPOL® and ALKAQUAT® (available from Alkaril Chemical Company), SANIZOL® (benzalkonium chloride, available from Kao Chemicals), and the like, as well as mixtures thereof.

Examples of suitable nonionic surfactants include, but are not limited to, polyvinyl alcohol, polyacrylic acid, methalose, methyl cellulose, ethyl cellulose, propyl cellulose, hydroxy ethyl cellulose, carboxy methyl cellulose, polyoxyethylene cetyl ether, polyoxyethylene lauryl ether, polyoxyethylene octyl ether, polyoxyethylene octylphenyl ether, polyoxyethylene oleyl ether, polyoxyethylene sorbitan monolaurate, polyoxyethylene stearyl ether, polyoxyethylene nonylphenyl ether, dialkylphenoxypoly(ethyleneoxy) ethanol (available from Rhone-Poulenc as IGEPAL CA-210®, IGEPAL CA-520®, IGEPAL CA-720®, IGEPAL CO-890®, IGEPAL CO-720®, IGEPAL CO-290®, IGEPAL CA-210®, ANTAROX 890®, and ANTAROX 897®) and the like, as well as mixtures thereof.

Initiators

Any suitable initiator or mixture of initiators may be selected in the latex process and the toner process. In embodiments, the initiator is selected from known free radical polymerization initiators. The free radical initiator can be any free radical polymerization initiator capable of initiating a free radical polymerization process and mixtures thereof, such free radical initiator being capable of providing free radical species on heating to above about 30° C.

Although water soluble free radical initiators are used in emulsion polymerization reactions, other free radical initiators also can be used. Examples of suitable free radical initiators include, but are not limited to, peroxides, such as, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, diisopropyl peroxycarbonate, tetralin hydroperoxide, 1-phenyl-2-methylpropyl-1-hydroperoxide and tert-butyl hydroperoxide; pertriphenylacetate, tert-butyl performate; tert-butyl peracetate; tert-butyl perbenzoate; tert-butyl perphenylacetate; tert-butyl permethoxyacetate; tert-butyl per-N-(3-toluyl)carbamate; sodium persulfate; potassium persulfate, azo compounds, such as, 2,2'-azobispropane, 2,2'-dichloro-2,2'-azobispropane, 1,1'-azo(methylethyl)diacetate, 2,2'-azobis(2-amidinopropane)hydrochloride, 2,2'-azobis(2-amidinopropane)-nitrate, 2,2'-azobisisobutane, 2,2'-azobisisobutylamide, 2,2'-azobisisobutyronitrile, methyl 2,2'-azobis-2-methylpropionate, 2,2'-dichloro-2,2'-azobisbutane, 2,2'-azobis-2-methylbutyronitrile, dimethyl 2,2'-azobisisobutyrate, 1,1'-azobis(sodium 1-methylbutyronitrile-3-sulfonate), 2-(4-methylphenylazo)-2-methylmalonod-initrile, 4,4'-azobis-4-cyanovaleric acid, 3,5-dihydroxymethylphenylazo-2-methylmalonodinitrile, 2-(4-bromophenylazo)-2-allylmalonodinitrile, 2,2'-azobis-2-methylvaleronitrile, dimethyl 4,4'-azobis-4-cyanovalerate, 2,2'-azobis-2,4-dimethylvaleronitrile, 1,1'-azobiscyclohexanenitrile, 2,2'-azobis-2-propylbutyronitrile, 1,1'-azobis-1-chlorophenylethane, 1,1'-azobis-1-cyclohexanecarbonitrile, 1,1'-azobis-1-cycloheptanenitrile, 1,1'-azobis-1-phenylethane, 1,1'-azobiscumene, ethyl 4-nitrophenylazobenzylcyanoacetate, phenylazodiphenylmethane, phenylazotriphenylmethane, 4-nitrophenylazotriphenylmethane, 1'-azobis-1,2-diphenylethane, poly(bisphenol A-4,4'-azobis-4-cyanopentano-ate) and poly (tetraethylene glycol-2,2'-azobisisobutyrate); 1,4-bis (pentaethylene)-2-tetrazene; 1,4-dimethoxycarbonyl-1,4-dipheny-l-2-tetrazene and the like; and mixtures thereof.

More typical free radical initiators include, but are not limited to, ammonium persulfate, hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethylbenzoyl peroxide, lauroyl peroxide, sodium persulfate, potassium persulfate, diisopropyl peroxycarbonate and the like.

Based on total weight of the monomers to be polymerized, the initiator may be present in an amount from about 0.1% to about 5%, from about 0.4% to about 4%, from about 0.5% to about 3%, although may be present in greater or lesser amounts.

A chain transfer agent optionally may be used to control the polymerization degree of the latex, and thereby control the molecular weight and molecular weight distribution of the product latexes of the latex process and/or the toner process according to the present disclosure. As can be appreciated, a chain transfer agent can become part of the latex polymer.

Chain Transfer Agent

In embodiments, the chain transfer agent has a carbon-sulfur covalent bond. The carbon-sulfur covalent bond has an absorption peak in a wave number region ranging from 500 to 800 cm-1 in an infrared absorption spectrum. When the chain transfer agent is incorporated into the latex and the toner made from the latex, the absorption peak may be changed, for example, to a wave number region of 400 to 4,000 cm-1.

Exemplary chain transfer agents include, but are not limited to, n-C3-15 alkylmercaptans, such as, n-propylmercaptan, n-butylmercaptan, n-amylmercaptan, n-hexylmercaptan, n-heptylmercaptan, n-octylmercaptan, n-nonylmercaptan, n-decylmercaptan and n-dodecylmercaptan; branched alkylmercaptans, such as, isopropylmercaptan, isobutylmercaptan, s-butylmercaptan, tert-butylmercaptan, cyclohexylmercaptan, tert-hexadecylmercaptan, tert-laurylmercaptan, tert-nonylmercaptan, tert-octylmercaptan and tert-tetradecylmercaptan; aromatic ring-containing mercaptans, such as, allylmercaptan, 3-phenylpropylmercaptan, phenylmercaptan and mercaptotriphenylmethane; and so on. The terms, mercaptan and thiol may be used interchangeably to mean C—SH group.

Examples of such chain transfer agents also include, but are not limited to, dodecanethiol, butanethiol, isooctyl-3-mercaptopropionate, 2-methyl-5-t-butyl-thiophenol, carbon tetrachloride, carbon tetrabromide and the like.

Based on total weight of the monomers to be polymerized, the chain transfer agent may be present in an amount from about 0.1° A to about 7%, from about 0.5% to about 6%, from about 1.0% to about 5%, although may be present in greater or lesser amounts.

In embodiments, a branching agent optionally may be included in the first/second monomer composition to control the branching structure of the target latex. Exemplary branching agents include, but are not limited to, decanediol diacrylate (ADOD), trimethylolpropane, pentaerythritol, trimellitic acid, pyromellitic acid and mixtures thereof.

Based on total weight of the monomers to be polymerized, the branching agent may be present in an amount from about 0% to about 2%, from about 0.05% to about 1.0%, from about 0.1% to about 0.8%, although may be present in greater or lesser amounts.

In the latex process and toner process of the disclosure, emulsification may be done by any suitable process, such as, mixing at elevated temperature. For example, the emulsion mixture may be mixed in a homogenizer set at about 200 to about 400 rpm and at a temperature of from about 40° C. to about 80° C. for a period of from about 1 min to about 20 min.

Any type of reactor may be used without restriction. The reactor can include means for stirring the compositions therein, such as, an impeller. A reactor can include at least one impeller. For forming the latex and/or toner, the reactor can be operated throughout the process such that the impellers can operate at an effective mixing rate of about 10 to about 1,000 rpm.

Following completion of the monomer addition, the latex may be permitted to stabilize by maintaining the conditions for a period of time, for example for about 10 to about 300 min, before cooling. Optionally, the latex formed by the above process may be isolated by standard methods known in the art, for example, coagulation, dissolution and precipitation, filtering, washing, drying or the like.

The latex of the present disclosure may be selected for emulsion-aggregation-coalescence processes for forming toners, inks and developers by known methods. The latex of the present disclosure may be melt blended or otherwise mixed with various toner ingredients, such as, a wax dispersion, a coagulant, an optional silica, an optional charge enhancing additive or charge control additive, an optional surfactant, an optional emulsifier, an optional flow additive and the like. Optionally, the latex (e.g. around 40% solids) may be diluted to the desired solids loading (e.g. about 12 to about 15% by weight solids), before formulated in a toner composition.

Based on the total toner weight, the latex may be present in an amount from about 50% to about 100%, from about 60% to about 98%, from about 70% to about 95%, although may be present in greater or lesser amounts. Methods of producing such latex resins may be carried out as described in the disclosure of U.S. Pat. No. 7,524,602, herein incorporated by reference in entirety.

Colorants

Various known suitable colorants, such as dyes, pigments, mixtures of dyes, mixtures of pigments, mixtures of dyes and pigments and the like may be included in the toner. The colorant may be included in the toner in an amount of, for example, about 0.1 to about 35% by weight of the toner, from about 1 to about 15% percent of the toner, from about 3 to about 10% by weight of the toner, although amounts outside those ranges may be utilized.

As examples of suitable colorants, mention may be made of carbon black like REGAL 330®; magnetites, such as, Mobay magnetites MO8029™ and MO8060™; Columbian magnetites; MAPICO BLACKS™, surface-treated magnetites; Pfizer magnetites CB4799™, CB5300™, CB5600™ and MCX6369™; Bayer magnetites, BAYFERROX 8600™ and 8610™; Northern Pigments magnetites, NP-604™ and NP-608™; Magnox magnetites TMB-100™ or TMB-104™; and the like. As colored pigments, there can be selected cyan, magenta, yellow, red, green, brown, blue or mixtures thereof. Generally, cyan, magenta or yellow pigments or dyes, or mixtures thereof, are used. The pigment or pigments can be water-based pigment dispersions.

Specific examples of pigments include SUNSPERSE 6000, FLEXIVERSE and AQUATONE water-based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™ PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, CINQUASIA MAGENTA™ available from E.I. DuPont de Nemours & Company and the like. Colorants that can be selected are black, cyan, magenta, yellow and mixtures thereof. Examples of magentas are 2,9-dimethyl-substituted quinacridone and anthraquinone dye identified in the Color Index as CI 60710, CI Dispersed Red 15, diazo dye identified in the Color Index as CI 26050, CI Solvent Red 19 and the like. Illustrative examples of cyans include copper tetra(octadecyl sulfonamido) phthalocyanine, x-copper phthalocyanine pigment listed in the Color Index as CI 74160, CI Pigment Blue, Pigment Blue 15:3, Anthrathrene Blue, identified in the Color Index as CI 69810, Special Blue X-2137 and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide and Permanent Yellow FGL. Colored magnetites, such as, mixtures of MAPICO BLACK™, and cyan components also may be selected as colorants. Other known colorants can be selected, such as, Levanyl Black A-SF (Miles, Bayer) and Sunsperse Carbon Black LHD 9303 (Sun Chemicals), and colored dyes, such as, Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing and the like.

Wax

In addition to the polymer resin, the toners of the present disclosure also may contain a wax, which can be either a single type of wax or a mixture of two or more different waxes. A single wax can be added to toner formulations, for example, to improve particular toner properties, such as, toner particle shape, presence and amount of wax on the toner particle surface, charging and/or fusing characteristics, gloss, stripping, offset properties and the like. Alternatively, a combination of waxes can be added to provide multiple properties to the toner composition.

When included, the wax may be present in an amount of, for example, from about 1 wt % to about 25 wt % of the toner particles, in embodiments, from about 5 wt % to about 20 wt % of the toner particles.

Waxes that may be selected include waxes having, for example, a weight average molecular weight of from about 500 to about 20,000, in embodiments from about 1,000 to about 10,000. Waxes that may be used include, for example, polyolefins, such as, polyethylene, polypropylene and polybutene waxes, such as, commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K. K.; plant-based waxes, such as, carnauba wax, rice wax, candelilla wax, sumacs wax and jojoba oil; animal-based waxes, such as, beeswax; mineral-based waxes and petroleum-based waxes, such as, montan wax, ozokerite, ceresin, paraffin wax, microcrystalline wax and Fischer-Tropsch wax; ester waxes obtained from higher fatty acid and higher alcohol, such as, stearyl stearate and behenyl behenate; ester waxes obtained from higher fatty acid and monovalent or multivalent lower alcohol, such as, butyl stearate, propyl oleate, glyceride monostearate, glyceride distearate, pentaerythritol tetra behenate; ester waxes obtained from higher fatty acid and multivalent alcohol multimers, such as, diethyleneglycol monostearate, dipropyleneglycol distearate, diglyceryl distearate and triglyceryl tetrastearate; sorbitan higher fatty acid ester waxes, such as, sorbitan monostearate, and cholesterol higher fatty acid ester waxes, such as, cholesteryl stearate. Examples of functionalized waxes that may be used include, for example, amines, amides, for example, AQUA SUPERSLIP 6550™ and SUPERSLIP 6530™ available from Micro Powder Inc., fluorinated waxes, for example, POLYFLUO 190™ POLYFLUO 200™, POLYSILK 19™ and POLYSILK 14™ available from Micro Powder Inc., mixed fluorinated, amide waxes, for example, MICROSPERSION 19™ available from Micro Powder Inc., imides, esters, quaternary amines, carboxylic acids or acrylic polymer emulsion, for example JONCRYL 74™, 89™, 130™, 537™ and 538™, all available from SC Johnson Wax, and chlorinated polypropylenes and polyethylenes available from Allied Chemical and Petrolite Corporation and SC Johnson wax. Mixtures and combinations of the foregoing waxes also may be used in embodiments. Waxes may be included as, for example, fuser roll release agents.

The toner particles of the present embodiments exhibits a dielectric loss of from about 20 to about 80, or from about 50 to about 70, or from about 40 to about 45. The toners of the present embodiments has a minimum fusing temperature (MFT) of from about 90 to about 150, or from about 100 to about 130, or from about 100 to about 125. The toner particles of the present embodiments exhibits a gloss from about 10 ggu to about 60 ggu, from about 20 ggu to about 70 ggu, or from about 30 ggu to about 70 ggu on plain paper The toner particles of the present embodiments have an average particle size of from about 4 μm to about 10 μm, from about 4 μm to about 7 μm, or from about 4 μm to about 20 μm The toner particles of the present embodiments have an average circularity of from about 0.93 to about 0.99, from about 0.96 to about 0.98, or from about 0.95 to about 0.99. The toner particles of the present embodiments have a shape factor of from about 120 to about 140, from about 110 to about 130, or from about 105 to about 150. The toner particles of the present embodiments have a volume geometric standard deviation for (D84/D50) in the range of from about 1.15 to about 1.25, from about 1.15 to about 1.30, or from about 1.20 to about 1.25. The toner particles of the present embodiments have a number geometric standard deviation for (D16/D50) in the range of from about 1.15 to about 1.25, from about 1.15 to about 1.30, or from about 1.20 to about 1.25.

Toner Preparation

The toner particles may be prepared by any method within the purview of one skilled in the art. Although embodiments relating to toner particle production are described below with respect to emulsion-aggregation processes, any suitable method of preparing toner particles may be used, including chemical processes, such as suspension and encapsulation processes disclosed in U.S. Pat. Nos. 5,290,654 and 5,302,486, the disclosure of each of which hereby is incorporated by reference in entirety. In embodiments, toner compositions and toner particles may be prepared by aggregation and coalescence processes in which smaller-sized resin particles are aggregated to the appropriate toner particle size and then coalesced to achieve the final toner particle shape and morphology.

In embodiments, toner compositions may be prepared by emulsion-aggregation processes, such as, a process that includes aggregating a mixture of an optional wax and any other desired or required additives, and emulsions including the resins described above, optionally with surfactants, as described above, and then coalescing the aggregate mixture. A mixture may be prepared by adding an optional wax or other materials, which optionally also may be in a dispersion(s) including a surfactant, to the emulsion, which may be a mixture of two or more emulsions containing the resin. The pH of the resulting mixture may be adjusted by an acid (i.e., a pH adjustor) such as, for example, acetic acid, nitric acid or the like. In embodiments, the pH of the mixture may be adjusted to from about 2 to about 4.5. Additionally, in embodiments, the mixture may be homogenized. If the mixture is homogenized, homogenization may be accomplished by mixing at about 600 to about 4,000 revolutions per minute (rpm). Homogenization may be accomplished by any suitable means, including, for example, with an IKA ULTRA TURRAX T50 probe homogenizer or a Gaulin 15MR homgenizer.

Following preparation of the above mixture, generally, an aggregating agent may be added to the mixture. Suitable aggregating agents include, for example, aqueous solutions of a divalent cation or a multivalent cation material. In the present embodiments, a polyaluminum halide, specifically, polyaluminum chloride (PAC) is used. PAC is a stronger multivalent flocculant as compared to aluminum sulfate, which is a bivalent flocculant. It was discovered that the PAC unexpectedly improves the surface morphology by reducing the amount of styrene-acrylate on the surface. It is believed that the multivalent PAC helps bind and keep the higher acid value styrene-acrylate latex to the core of the toner particles.

In using the PAC, the manufacturing process is modified to lengthen the coalescence time (as compared to that used with conventional flocculants like aluminum sulfate) to from about 1 hour to about 3 hours, or from about 1.5 hours to about 2.5 hours. It was discovered that this modification of longer coalescence time is needed to smooth the toner surface and obtain optimal surface morphology.

Other aggregating agents that may be used include the corresponding bromide, fluoride or iodide, and combinations thereof. In embodiments, the aggregating agent is present in the toner composition in an amount of from about 0.1 to about 1.0 percent, or of from about 0.2 to about 0.8 percent, or of from about 0.25 to about 0.5 percent by weight of the total weight of the toner particles. In embodiments, the aggregating agent may be added to the mixture at a temperature that is below the glass transition temperature (Tg) of the resin. As discussed above, the reduced coalescence temperature used is from about 70 to about 90° C., or from about 70 to about 80° C., or from about 70 to about 77° C.

The aggregating agent may be added to the mixture to form a toner in an amount of, for example, from about 0.1 parts per hundred (pph) to about 1 pph of the toner particles, in embodiments, from about 0.25 pph to about 0.75 pph of the toner particles.

The gloss of a toner may be influenced by the amount of retained metal ion, such as, Al3+, in the particle. The amount of retained metal ion may be adjusted further by the addition of ethylene diamine tetraacetic acid (EDTA). In embodiments, the amount of retained metal ion, for example, Al3+, in toner particles of the present disclosure may be from about 0.1 pph to about 1 pph, in embodiments, from about 0.25 pph to about 0.8 pph.

The disclosure also provides a melt mixing process to produce low cost and safe cross-linked thermoplastic binder resins for toner compositions which have, for example, low fix temperature and/or high offset temperature, and which may show minimized or substantially no vinyl offset. In the process, unsaturated base polyester resins or polymers are melt blended, that is, in the molten state under high shear conditions producing substantially uniformly dispersed toner constituents, and which process provides a resin blend and toner product with optimized gloss properties (see, e.g., U.S. Pat. No. 5,556,732, herein incorporated by reference in entirety). By, "highly cross-linked," is meant that the polymer involved is substantially cross-linked, that is, equal to or above the gel point. As used herein, "gel point," means the point where the polymer is no longer soluble in solution (see, e.g., U.S. Pat. No. 4,457,998, herein incorporated by reference in entirety).

To control aggregation and coalescence of the particles, in embodiments, the aggregating agent may be metered into the mixture over time. For example, the agent may be metered into the mixture over a period of from about 5 to about 240 min, in embodiments, from about 30 to about 200 min. Addition of the agent may also be done while the mixture is maintained under stirred conditions, in embodiments from about 50 rpm to about 1,000 rpm, in embodiments, from about 100 rpm to about 500 rpm, and at a temperature that is below the Tg of the resin.

The particles may be permitted to aggregate until a predetermined desired particle size is obtained. A predetermined desired size refers to the desired particle size as determined prior to formation, with particle size monitored during the growth process as known in the art until such particle size is achieved. Samples may be taken during the growth process and analyzed, for example with a Coulter Counter, for average particle size. The aggregation thus may proceed by maintaining the elevated temperature, or slowly raising the temperature to, for example, from about 40° C. to about 65° C., and holding the mixture at that temperature for a time from about 0.5 hour to about 6 hour, in embodiments, from about 1 hour to about 5 hour, while maintaining stirring, to provide the aggregated particles. Once the predetermined desired particle size is obtained, the growth process is halted. In embodiments, the predetermined desired particle size is within the toner particle size ranges mentioned above. In embodiments, the particle size may be about 5.0 to about 6.0 μm, about 6.0 to about 6.5 μm, about 6.5 to about 7.0 μm, about 7.0 to about 7.5 μm.

Growth and shaping of the particles following addition of the aggregation agent may be accomplished under any suitable conditions. For example, the growth and shaping may be conducted under conditions in which aggregation occurs separate from coalescence. For separate aggregation and coalescence stages, the aggregation process may be conducted under shearing conditions at an elevated temperature, for example from about 38° C. to about 55° C., in embodiments, from about 40° C. to about 50° C., which may be below the Tg of the resin.

Following aggregation to the desired particle size, with the optional formation of a shell as described above, the particles then may be coalesced to the desired final shape, the coalescence being achieved by, for example, heating the mixture to a temperature of from about 65° C. to about 90° C., in embodiments from about 70° C. to about 80° C., which may be below the melting point of a crystalline resin to prevent plasticization. Higher or lower temperatures may be used, it being understood that the temperature is a function of the resins used.

Coalescence may proceed over a period of from about 0.1 to about 9 hour, in embodiments, from about 0.5 to about 4 hour.

After coalescence, the mixture may be cooled to room temperature, such as from about 20° C. to about 25° C. The cooling may be rapid or slow, as desired. A suitable cooling method may include introducing cold water to a jacket around the reactor. After cooling, the toner particles optionally may be washed with water and then dried. Drying may be accomplished by any suitable method, for example, freeze drying.

Toners may possess favorable charging characteristics when exposed to extreme RH conditions. The low humidity zone (C zone) may be about 12° C./15% RH, while the high humidity zone (A zone) may be about 28° C./85% RH. Toners of the disclosure may possess a parent toner charge per mass ratio (Q/M) of from about −5 μC/g to about −80 μC/g, in embodiments, from about −10 μC/g to about −70 μC/g, and a final toner charging after surface additive blending of from −15 μC/g to about −60 μC/g, in embodiments, from about −20 μC/g to about −55 μC/g.

EXAMPLES

Example 1

Preparation of Core Polyester Latex with 5% Triethyl Citrate (TEC)

In a 2 L glass reactor, 103.68 g of amorphous polyester emulsion A, 103.68 g of amorphous polyester emulsion B, and 6.68 g of triethyl citrate (5 wt % relative to total resin, available from Sigma Aldrich) were combined and stirred for 1 hour at 250 RPM to obtain a latex emulsion (core polyester latex).

Preparation of Hybrid Toner Containing 5% TEC

To the 2 L glass reactor containing the latex emulsion prepared above was added 20.62 g of styrene-acrylate latex emulsion C, 29.65 g of crystalline polyester emulsion D, 20.42 g of IGI wax, 10.37 g of cyan pigment (PB15:3), 51.40 g of black pigment (Nipex-35) and 525.43 g of DI water. Subsequently, 2.70 g of PAC (polyaluminum chloride) was mixed with 33.30 g of 0.02M nitric acid, and then added to the slurry under homogenization at 3000-4000 RPM, and the pH was adjusted from 7.0 to 4.5 with 0.3M nitric acid. The reactor was set to 370 RPM and was heated to 48° C. to aggregate the toner particles. When the particle size reaches 6-7 μm, a shell coating was added which contains 106.51 g styrene-acrylate latex emulsion C, the stirring speed was reduced to 200 RPM. The reaction mixture was further heated to 50° C. When the toner particle size reaches 7-8 microns, the stirring speed was lowered further to 80 RPM and freezing begins by pH adjusting the slurry with 13.61 grams of a chelating agent (Versene100) until pH reaches 7.80. The reactor temperature was ramped to 70° C. Once at 70° C., the pH of the slurry was reduced from 7.03 to 4.00 with 87.50 g of 0.3M nitric acid. The reactor temperature was further ramped to 75° C. Once at the coalescence temperature, the slurry was coalesced for 90 minutes until the particle circularity is between 0.970-0.980 as measured by the Flow Particle Image Analysis (FPIA) instrument. The slurry was then quench cooled in 666 g DI ice. The final particle size was 8.96 microns, GSDv 1.18, GSDn 1.30 and a circularity of 0.980. The toner was then washed and freeze-dried.

Example 2

Example 2 was prepared using the same process described in Example 1 where the core polyester latex was treated with 5% triethyl citrate (TEC) except that the coalescence temperature was set at 80° C. instead of 75° C. The final particle size was 7.12 microns, GSDv 1.20, GSDn 1.23 and a circularity of 0.977. The toner was then washed and freeze-dried.

Example 3

Example 3 was prepared using the same process described in Example 1 except that the shell styrene-acrylate latex emulsion was treated with 2% dimethyl phthalate (DMP) before adding to the core latex and the coalescence temperature used was 75° C. The final particle size was 5.96 microns, GSDv 1.21, GSDn 1.27 and a circularity of 0.963. The toner was then washed and freeze-dried.

Example 4

Example 4 was prepared using the same process described in Example 1 except that the shell styrene-acrylate latex emulsion was treated with 2% triethyl citrate (TEC) before adding to the core latex and the coalescence temperature used was 75° C. The final particle size was 5.96 microns, GSDv 1.20, GSDn 1.27 and a circularity of 0.965. The toner was then washed and freeze-dried.

Comparative Example 5

Control Toner Example 5 was prepared using the same process described in Example 1 except that no antiplasticizer was added to the core. Control Toner Example 2 was coalesced at 85° C., pH 4 for 90 minutes with a final particle size of 5.77 microns, GSDv 1.21, GSDn 1.20 and a circularity of 0.991.

Comparative Example 6

Control Toner Example 6 was prepared using the same process described in Example 1 except that no antiplasticizer was added to the core. Control Toner Example 3 was coalesced at 80° C., pH 4 for 90 minutes with a final particle size of 6.27 microns, GSDv 1.22, GSDn 1.21 and a circularity of 0.987.

Comparative Example 7

Control Toner Example 7 was prepared using the same process described in Example 1 except that no antiplasticizer was added to the core. Control Toner Example 3 was coalesced at 75° C., pH 4 for 90 minutes with a final particle size of 5.60 microns, GSDv 1.20, GSDn 1.41 and a circularity of 0.976.

Example 8

Toner Evaluation

Bench developer performance was obtained for both the parent toner particles (i.e., without any external toner additives), and of a toner blended with a set of external additives.

Toner Additive Blending

For each sample, about 50 g of the toner were added to an SKM mill along with an additive package including silica, titania and zinc stearate and then blended for about 30 seconds at approximately 12500 rpm. Surface additives were 1.29% RY50L silica, 0.86% RX50 silica, 0.88% STT100H titania, 1.73% X24 sol-gel colloidal silica, and 0.18% zinc stearate, 0.5% PMMA and 0.28% cerium oxide particles.

Toner Charging

Toner charging was collected for both the parent toner particle without any surface additives and for the blended toner particle with surface additives. For parent toner particles 5 pph of toner in carrier was prepared, 1.5 grams of toner and 30 grams of XEROX® 700 carrier in a 60 mL glass bottle, for the blended toner at 6 pph of toner in carrier, 1.8 grams of toner and 30 grams of Xerox 700 carrier in a 60 mL glass bottle. Samples were conditioned three days in a low-humidity zone (J zone) at 21.1° C. and 10% RH), and in a separate sample in a high humidity zone (A zone) at about 28° C./85% relative humidity. The developers with parent toner particles were charged in a Turbula mixer for 10 minutes, the developers with additive blended toner were charged in a Turbula mixer for 60 minutes.

Toner Blocking

Toner blocking was determined by measuring the toner cohesion at elevated temperature above room temperature. Toner blocking measurement is completed as follows: two grams of additive toner was weighed into an open dish and conditioned in an environmental chamber at the specified elevated temperature and 50% relative humidity. After about 17 hours the samples were removed and acclimated in ambient conditions for about 30 minutes. Each re-acclimated sample was measured by sieving through a stack of two pre-weighed mesh sieves, which were stacked as follows: 1000 μm on top and 106 μm on bottom. The sieves were vibrated for about 90 seconds at about 1 mm amplitude with a Hosokawa flow tester.

Dielectric Loss

Also measured was dielectric loss in a custom-made fixture connected to an HP4263B LCR Meter via shielded 1 meter BNC cables. To ensure reproducibility and consistency, one gram of toner (conditioned in C-zone 24 h) was placed in a mold having a 2-inch diameter and pressed by a precision-ground plunger at about 2000 psi for 2 minutes. While maintaining contact with the plunger (which acted as one electrode), the pellet was then forced out of the mold onto a spring-loaded support, which kept the pellet under pressure and also acted as the counter-electrode. The current set-up eliminated the need for using additional contact materials (such as tin foils or grease) and also enabled the in-situ measurement of pellet thickness. Dielectric and dielectric loss were determined by measuring the capacitance (Cp) and the loss factor (D) at 100 KHz frequency and 1 VAC. The measurements were carried out under ambient conditions.

The dielectric constant was calculated as follows:

$$E'=[Cp(\text{pF})\times\text{Thickness(mm)}]/[8.854\times A\text{effective(m2)}]$$

The constant "8.854" in the formula above is the vacuum electrical permittivity $\in_o$ in units that takes into account the fact that Cp is in picofarads (not farads), and thickness is in mm (not meters). Aeffective is the effective area of the sample. Dielectric loss=E*Dissipation factor, which measures the electrical dissipation of the sample (i.e., how leaky a capacitor it was). For simplification purpose in the present application, the value E' is multiplied by 1000. Accordingly, a reported dielectric loss value of 70 indicated a dielectric loss of $70\times10^{-3}$, or 0.070.

Toner Evaluation Results

The toner evaluation results are shown in Table 2 below. The data shows that the hybrid toner of Example 1 provides very low dielectric loss of 43,000 which is comparable with the production control black toner (current low melt polyester toner). The parent charging of the antiplasticized toner is similar to the production control toner, if not a little improved for the A-zone.

TABLE 2

| Example No | Dielectric Loss ×1000 | Blocking Onset ≥ 52° C. (Pinot) | Q/M A-zone (μC/g) | Q/M J-zone (μC/g) |
|---|---|---|---|---|
| Example 1 with antiplasticizer | 43 | 52.2 | 17.5 | 56.1 |
| Example 2 with antiplasticizer | 69 | No data | No data | No data |
| Example 3 with antiplasticizer | 63 | 54.0 | No data | No data |
| Example 4 with antiplasticizer | 64 | 54.3 | No data | No data |
| Example 5 | 143 | 55.5 | No data | No data |
| Example 6 | 70 | 54.2 | 11.2 | 80.4 |
| Example 7 | 47 | 52.8 | No data | No data |
| Production control toner | 37 | 53.0 | 12.7 | 52.1 |

Figure 3A:
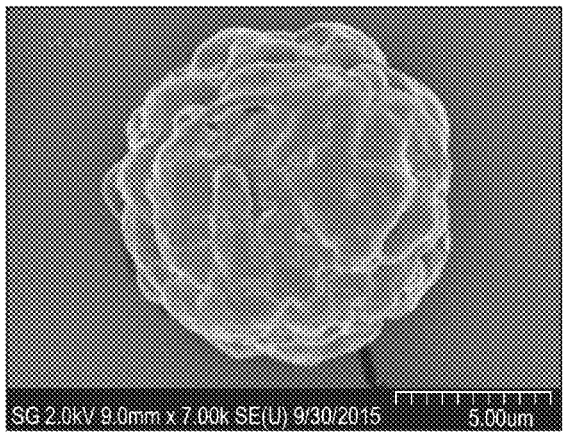
FIG. 3*a* provides a scanning electron microscope (SEM) image of a hybrid toner made according to the present embodiments.
Figure 3B:
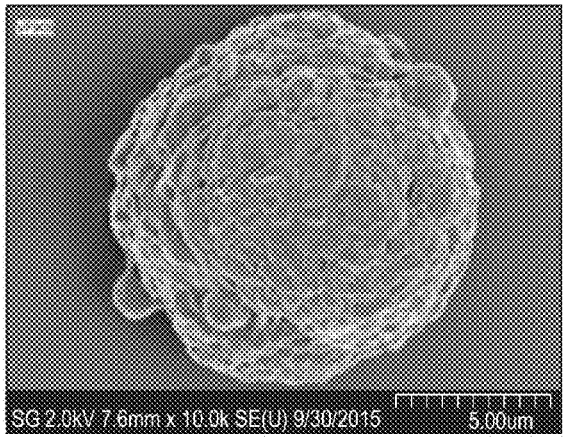
FIG. 3*b* provides a SEM image of a control hybrid toner without the presence of an antiplasticizer.
Figure 4:
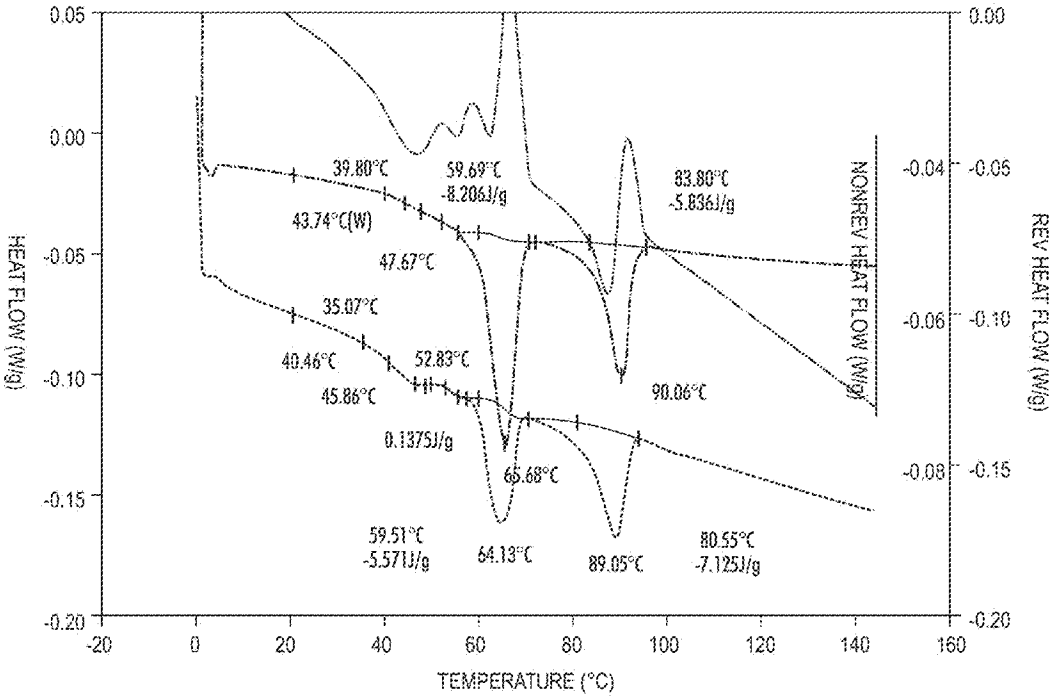
FIG. 4 provides a modulated differential scanning calorimetry (MDSC) of a hybrid toner made according to the present embodiments.
Figure 5:
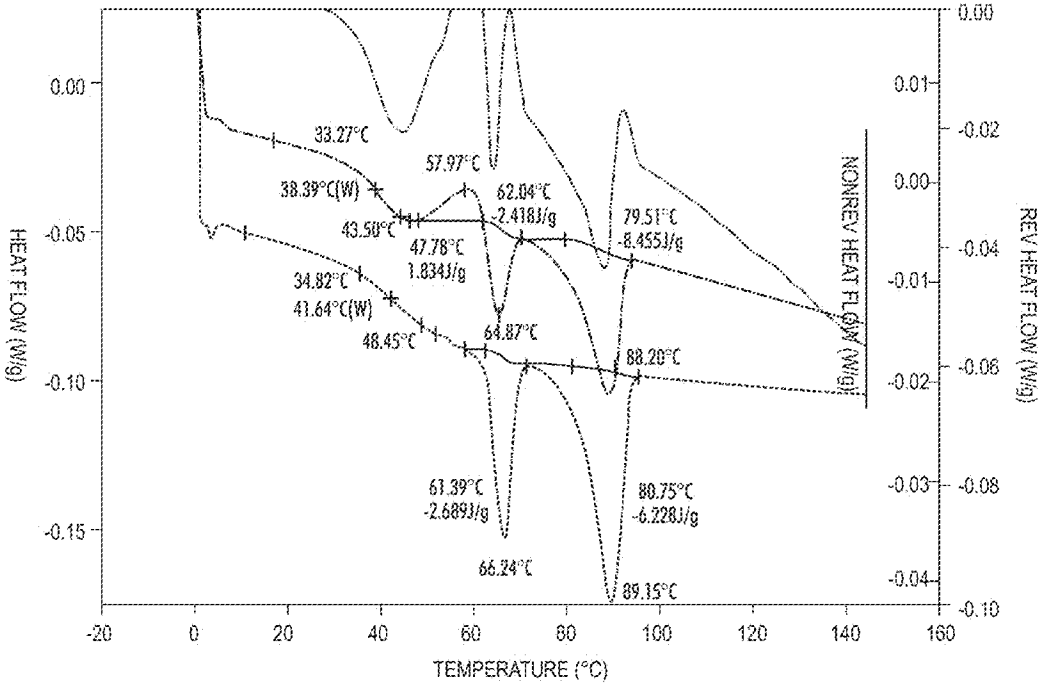
FIG. 5 provides a MDSC of a control hybrid toner without the presence of an antiplasticizer.

FIGS. 3*a* and 3*b* are scanning electron microscope (SEM) images showing the morphology of the hybrid toner of Example 1 made with antiplasticizer (left) and a standard hybrid toner coalesced at 75° C. for 90 minutes (Example 7) made without antiplasticizer (left). The morphology of the hybrid toner of Example 1 made with antiplasticizer shows a less textured surface than the standard hybrid toner of Example 7 made with no antiplasticizer. Table 3 summaries the toners' core and shell composition, coalescence condition and toner evaluation results. Coalescing at 75° C. improves the dielectric loss of the standard hybrid toner from 143 to 47° C., but the surface texture of the standard hybrid is not acceptable. The modulated differential scanning calorimetry (MDSC) is shown in FIG. 4.

Detectability

The addition of an antiplasticizer is detected through the differences in the MDSC "fingerprint", specifically the non-reversing heat capacity (in brown; it is the kinetic (time dependent) component) which is the difference between the total heat capacity and the reversing heat capacity. The nonreversing transitions will give evidence about enthalpic recovery, evaporation, crystallization, thermoset cure, decomposition and some melting information. The reversing transition provides information about heat capacity, glass transition and most melting data.

$$MDSC^{®}\ \text{Heat Flow \& Signals}$$

$$\frac{dH}{dt} = Cp\frac{dT}{dt} + f(T, t)$$

$$\text{Total} = \text{Reversing} + \text{Nonreversing}$$

Fusing

Fusing of a toner with an anti-plasticizer (5% triethyl citrate) incorporated in the core was similar to other hybrid samples. The sample had a gloss curve that was similar to lab and production control toners (TG40~131 to 134° C.). and a crease area curve (MFT=126° C. versus 123° C.) that is approaching the production control reference. Hot offset temperature remained lower (184° C. versus 195° C.) than the production control but comparable to other hybrid toner samples.

TABLE 3

| Toner property | Example 1 Disclosure hybrid toner with 5% TEC in core | Example 2 Disclosure hybrid toner with 5% TEC in core | Example 3 Disclosure hybrid toner with 2% DMP in shell | Example 4 Disclosure hybrid toner with 2% TEC in shell | Example 5 Control hybrid toner | Example 6 Control hybrid toner | Example 7 Control hybrid toner | Production Control |
|---|---|---|---|---|---|---|---|---|
| Coalescence time/temperature | 90'/75° C. | 90'/80° C. | 90'/75° C. | 90'/75° C. | 90'/85° C. | 90'/80° C. | 90'/75° C. | 180'/85° C. |
| Size (μm)/GSDv/GSDn | 8.96/ 1.18/1.30 | 7.12/ 1.20/123 | 5.96/ 1.21/1.27 | 5.96/ 1.21/1.27 | 5.77/ 1.21/1.20 | 6.27/ 1.22/1.21 | 5.60/ 1.20/1.41 | 5.43/ 1.19/1.22 |
| Fines: 1.41-3.15 μm | 5.51% | 7.90% | 9.00% | 9.47% | 0.76% | 2.25% | 15.24% | ~15% |
| Circularity | 0.980 | 0.977 | 0.963 | 0.965 | 0.991 | 0.987 | 0.976 | 0.974 |
| Gloss 40 Temperature | No data | 133° C. | 129° C. | 129° C. | 134° C. | 131° C. | 134° C. | 133° C. |
| Peak Gloss | No data | 54 | 69 | 68 | 60 | 56 | 62 | 65 |
| Crease MFT temperature | No data | 126° C. | 125° C. | 126° C. | 129° C. | 129° C. | 131° C. | 123° C. |
| Mottle/HOT temperature | No data | 169° C./ >184° C. | 189° C./ >189° C. | 188° C./ >188° C. | 165° C./ >185° C. | 150° C./ >180° C. | 185° C./ >190° C. | 190° C./ >195° C. |

Fusing of a toner with an anti-plasticizer (2% triethyl citrate or dimethyl phthalate) incorporated in the shell was also similar to other hybrid samples. The samples had a gloss curve that was slightly lower (129° C.) than lab and production control toners (TG40~131 to 134° C.) and a crease area curve (MFT=125-126° C. versus 123° C.) that is approaching the production control reference. Hot offset temperature was improved compared to sample with anti-plasticizer in core (188-189° C. versus 184° C.) but still slightly lower than the production control (195° C.).

What is claimed is:

1. A composition comprising:

particles having a core and a shell disposed over the core, wherein the core comprises:

a first antiplasticizer;

a first styrene-acrylate resin; and a polyester resin;

the shell comprises:

a second styrene-acrylate resin.

2. The composition of claim 1, wherein the first antiplasticizer has a melting point of from about −30° C. to about 500° C.

3. The composition of claim 1, wherein the first antiplasticizer is selected from the group consisting of an alkyl benzoate, a citrate, an alkyl toluate, a phthalate, and mixtures thereof.

4. The composition of claim 1, wherein the first antiplasticizer comprises a citrate.

5. The composition of claim 1, wherein the first antiplasticizer is present in the toner composition in an amount of from about 0.1 to about 10 percent by weight of the total weight of the toner particles.

6. The composition of claim 1, wherein the shell includes a second antiplasticizer which is same or different from the first antiplasticizer in the core.

7. The composition of claim 1, wherein the polyester resin comprises a crystalline polyester resin and an amorphous resin.

8. The composition of claim 1, wherein the crystalline polyester resin is presented in the core in an amount of from about 5 to about 50 percent by weight of the toner components.

9. The composition of claim 1, wherein the amorphous polyester resin is presented in the core in an amount of from about 10 to about 95 percent by weight of the toner.

10. The composition of claim 1, wherein the amorphous polyester resin is selected from the group consisting poly (alkoxylated bisphenol-A co-fumarate-co-terephthalate-cododecenylsuccinate), poly(propoxylated bisphenol co-fumarate), poly(ethoxylated bisphenol co-fumarate), and mixtures thereof.

11. The composition of claim 1, wherein the first styrene-acrylate resin is present in the core in an amount of from about 7 to about 50 percent by weight of the total weight of the composition and the second styrene-acrylate resin is present in the shell in an amount of from about 7 to about 50 percent by weight of the total weight of the composition.

12. The composition of claim 1, wherein the styrene-acrylate resin in the core and the styrene-acrylate resin in the shell are independently selected from the group consisting of poly(styrene-alkyl acrylate), poly(styrene-alkyl methacrylate), poly(styrene-alkyl acrylate-acrylic acid), poly(styrene-alkyl methacrylate-acrylic acid), poly(alkyl methacrylate-alkyl acrylate), poly(alkyl methacrylate-aryl acrylate), poly (aryl methacrylate-alkyl acrylate), poly(alkyl methacrylate-acrylic acid), poly(styrene-alkyl acrylate-acrylonitrile-acrylic acid), poly(alkyl acrylate-acrylonitrile-acrylic acid), poly(methyl methacrylate-butadiene), poly(ethyl methacrylate-butadiene), poly(propyl methacrylate-butadiene), poly (butyl methacrylate-butadiene), poly(methyl acrylate-butadiene), poly(ethyl acrylate-butadiene), poly(propyl acrylate-butadiene), poly(butyl acrylate-butadiene), poly(styrene-isoprene), poly(methylstyrene-isoprene), poly(methyl methacrylate-isoprene), poly(ethyl methacrylate-isoprene), poly(propyl methacrylate-isoprene), poly(butyl methacrylate-isoprene), poly(methyl acrylate-isoprene), poly(ethyl acrylate-isoprene), poly(propyl acrylate-isoprene), poly(butyl acrylate-isoprene), poly(styrene-propyl acrylate), poly (styrene-butyl acrylate), poly(styrene-butyl acrylate-acrylic acid), poly(styrene-butyl acrylate-methacrylic acid), poly (styrene-butyl acrylate-acrylonitrile), poly(styrene-butyl acrylate-acrylonitrile-acrylic acid), poly(styrene-1,3-diene), poly(styrene-1,3-diene-acrylic acid), poly (styrene-1,3-diene-acrylonitrile-acrylic acid), poly(styrene-butadiene), poly(methylstyrene-butadiene), poly (styrene-butadiene-acrylic acid), poly(styrene-butadiene-methacrylic acid), poly(styrene-butadiene-acrylonitrile-acrylic acid), poly(styrene-butyl acrylate-acrylic acid), poly(styrene-butyl acrylate-methacrylic acid), poly(styrene-butyl acrylate-acrylononitrile), poly(styrene-butyl acrylate-acrylonitrile-acrylic acid), poly(styrene-butadiene), poly(styrene-isoprene), poly (styrene-butyl methacrylate), poly(styrene-butyl methacrylate-acrylic acid), poly(butyl methacrylate-butyl acrylate), poly(butyl methacrylate-acrylic acid), poly(acrylonitrile-butyl acrylate-acrylic acid), and mixtures thereof.

13. The composition according to claim 1, wherein both the first styrene-acrylate resin and the second styrene-acrylate resin each comprises a styrene alkyl acrylate polymer.

14. The composition according to claim 1, wherein the first styrene-acrylate resin and the second styrene-acrylate resin are the same.

15. The composition of claim 1 having a minimum fusing temperature of from about 90 to about 150° C.

16. The composition of claim 1 having a dielectric loss of from about 5 to about 65.

17. A toner composition comprising toner particles having a core and a shell disposed over the core, wherein the core comprises:

a first antiplasticizer;

a first styrene-acrylate resin;

a polyester resin; and the shell comprises:

a second styrene-acrylate resin.

18. The toner composition of claim 17, wherein the shell includes a second antiplasticizer which is same or different from the first antiplasticizer in the core.

19. A method of making a plurality of particles comprising providing an emulsion comprising a resin, an optional colorant, and an optional wax, and an antiplasticizer, wherein the resin comprises a first styrene-acrylate resin and a polyester resin;

aggregating the emulsion to form particle cores;

forming a shell over the particle cores to form particles, wherein the shell comprises a second styrene-acrylate resin; and coalescing the particles.

20. The method of claim 19, wherein the antiplasticizer is added to the emulsion at a temperature that is below the glass transition temperature ($T_g$) of the first styrene-acrylate resin and below the glass transition temperature ($T_g$) of the crystalline polyester resin.

* * * * *